US012345029B2

(12) United States Patent
Reich

(10) Patent No.: US 12,345,029 B2
(45) Date of Patent: Jul. 1, 2025

(54) BATH FAUCET SYSTEM

(71) Applicant: KOHLER CO, Kohler, WI (US)

(72) Inventor: Adam John Reich, Whitelaw, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 18/436,629

(22) Filed: Feb. 8, 2024

(65) Prior Publication Data

US 2024/0183135 A1 Jun. 6, 2024

Related U.S. Application Data

(63) Continuation of application No. 17/517,415, filed on Nov. 2, 2021, now Pat. No. 11,920,329.

(60) Provisional application No. 63/115,964, filed on Nov. 19, 2020.

(51) Int. Cl.
*E03C 1/04* (2006.01)
*E03C 1/02* (2006.01)

(52) U.S. Cl.
CPC ..... *E03C 1/0404* (2013.01); *E03C 1/023* (2013.01); *E03C 1/04* (2013.01); *E03C 1/0403* (2013.01); *E03C 2201/30* (2013.01); *Y10T 137/9464* (2015.04)

(58) Field of Classification Search
CPC ..... E03C 1/0404; E03C 1/023; E03C 1/04; E03C 1/0403; E03C 2201/30; Y10T 137/9464
USPC ..... 137/801
See application file for complete search history.

(56) References Cited

U.S. PATENT DOCUMENTS

| | | | |
|---|---|---|---|
| 3,600,723 | A | 8/1971 | Mongerson |
| 4,026,328 | A | 5/1977 | Nelson |
| 4,103,709 | A | 8/1978 | Fischer |
| 4,387,738 | A | 6/1983 | Bisonaya et al. |
| 4,979,539 | A | 12/1990 | Rohr |
| 5,669,417 | A | 9/1997 | Kuo |
| 5,924,451 | A | 7/1999 | Kuo |

(Continued)

FOREIGN PATENT DOCUMENTS

| | | | |
|---|---|---|---|
| CN | 101454602 | A | 6/2009 |
| CN | 103688000 | A | 3/2014 |

OTHER PUBLICATIONS

Notice of Allowance on U.S. Appl. No. 17/517,415 DTD Nov. 3, 2023.

(Continued)

*Primary Examiner* — John Bastianelli
(74) *Attorney, Agent, or Firm* — FOLEY & LARDNER LLP

(57) ABSTRACT

A bath faucet system includes a housing, an internal waterway, and a diverter rod. The housing includes a water inlet, a water outlet, and a cavity extending between the water inlet and the water outlet. The internal waterway is disposed within the cavity between the water inlet and the water outlet. The internal waterway includes a water jacket coupled to the water inlet and comprising a hose connector and a separate aperture through the water jacket. The internal waterway further includes a hose coupled to the hose connector and the water outlet and configured to prevent water from contacting the housing as water flows through the internal waterway. The diverter rod extends through the aperture of the water jacket and is configured to move relative to the water jacket between an open position and a closed position.

20 Claims, 8 Drawing Sheets

(56) References Cited

U.S. PATENT DOCUMENTS

| | | | | |
|---|---|---|---|---|
| 5,937,892 | A | 8/1999 | Meisner et al. | |
| 6,668,393 | B1 | 12/2003 | Mascari et al. | |
| 6,817,379 | B2 | 11/2004 | Perla | |
| 7,082,966 | B2 | 8/2006 | Kuo | |
| 7,992,590 | B2 | 8/2011 | Meehan et al. | |
| 8,046,850 | B2 | 11/2011 | Chang | |
| 8,079,098 | B2 | 12/2011 | Thomas | |
| 8,104,512 | B2 * | 1/2012 | Nelson | E03C 1/084 4/678 |
| 8,156,963 | B2 | 4/2012 | Lopp et al. | |
| 8,430,345 | B2 | 4/2013 | Esche et al. | |
| 8,590,572 | B2 | 11/2013 | Nelson et al. | |
| 9,518,382 | B2 | 12/2016 | Jonte et al. | |
| 9,896,825 | B2 | 2/2018 | Didea et al. | |
| 9,951,880 | B2 | 4/2018 | Thomas et al. | |
| 10,161,118 | B2 | 12/2018 | Swarte et al. | |
| 2006/0085906 | A1 * | 4/2006 | Tan | E03C 1/0404 4/678 |
| 2006/0191572 | A1 | 8/2006 | Breda | |
| 2006/0202142 | A1 | 9/2006 | Marty et al. | |
| 2011/0297248 | A1 | 12/2011 | Nelson et al. | |
| 2013/0020794 | A1 | 1/2013 | Stokes et al. | |
| 2014/0325752 | A1 | 11/2014 | Tuineag | |

OTHER PUBLICATIONS

Office Action issued in connection with Chinese Appl. No. 202111367041.0 dated Sep. 28, 2023.

* cited by examiner

Detail A

BATH FAUCET SYSTEM

CROSS REFERENCE TO RELATED PATENT APPLICATIONS

This application is a continuation of U.S. patent application Ser. No. 17/517,415 filed Nov. 2, 2021, which claims the benefit of and priority to U.S. Provisional Patent Application No. 63/115,964 filed Nov. 19, 2020, both of which are incorporated by reference herein in their entireties.

BACKGROUND

The present disclosure relates generally to bath faucet systems. More specifically, the present disclosure relates to a bath faucet system that incorporates a waterway to prevent water from contacting a bath faucet body.

Bath faucet systems often are made of a select range of materials due to the faucet body being exposed to water flow. The materials that are typically selected experience little to no oxidation when exposed to water. These materials may be expensive or may not be aesthetically pleasing. Furthermore, waterways designed to prevent water flow from making contact with a faucet body are difficult to design due to the movement of diverters (e.g., diverter rods, etc.) disposed within the faucet body. Accordingly, a system that provides flexibility to use a wide range of materials for a bath faucet body, that is easy to install, and does not interrupt the operation of a diverter would be desirable.

SUMMARY

At least one embodiment relates to a bath faucet system. The bath faucet system includes a housing, and an internal waterway. The housing forms an outer shell of the bath faucet system and includes a water inlet, a water outlet, and a cavity extending between the water inlet and the water outlet. The internal waterway is disposed within the cavity between the water inlet and the water outlet. The internal waterway includes a water jacket and a hose. The water jacket is coupled to the water inlet and configured to contain water flowing into the housing via the water inlet. The water jacket includes a hose connector along an outside surface of the water jacket. The hose includes a first end coupled to the hose connector, a second end coupled to the water outlet, and a central portion connecting the first end to the second end and configured to prevent water from contacting the housing as the water flows through the housing.

In some embodiments, the bath faucet system includes a diverter assembly disposed at least partially within the cavity. The water jacket includes an aperture and the diverter assembly includes a diverter rod extending through the aperture and configured to move relative to the water jacket between an open positon and a closed position. In some embodiments, the diverter assembly includes one or more seals positioned between the diverter rod and the water jacket. In still some embodiments, the one or more seals includes a first set of seals and a second set of seals. The first set of seals are positioned between the diverter rod and the water jacket and configured to prevent water from leaking out of the water jacket via the aperture. The second set of seals are positioned between the diverter rod and an inlet to the diverter assembly and configured to prevent water from entering the diverter assembly when diverter rod is in the closed position.

In some embodiments, the bath faucet system includes a diverter assembly disposed at least partially within the cavity. The hose connector is offset from the diverter assembly such that the hose does not abut the diverter assembly within the cavity.

In some embodiments, the housing includes mounting clips fixedly coupled to an internal surface of the shell and configured to receive the hose.

In some embodiments, the water jacket includes a circumferential sidewall defining a hollow cavity therein.

In some embodiments, the housing is formed of a material having a low level of resistance to fluids within a pH range of 6.5 to 8.5.

In some embodiments, the central portion of the hose defines a curvilinear sidewall extending between the hose connector and the water outlet.

In some embodiments, the bath faucet system includes a diverter assembly disposed at least partially within the cavity. The diverter assembly is selectively repositionable between an open position and a closed position. The diverter assembly permits water to flow through the bath faucet system when the diverter assembly is in the open position. The diverter assembly prevents water from flowing through the bath faucet system when the diverter assembly is in the closed position.

Another example embodiment relates to an internal waterway. The internal waterway is configured to deliver water between a water inlet and a water outlet of a bath faucet. The internal waterway includes a water jacket and a hose. The water jacket is coupled to the water inlet and configured to contain water. The water jacket includes a hose connector along an outside surface of the water jacket and protruding outward from the water jacket. The hose connector includes a hole extending therethrough. The hose includes a first end coupled to the hose connector, a second end coupled to the water outlet, and a central portion connecting the first end to the second end and configured to transfer water therein.

In some embodiments, the water jacket includes a circumferential sidewall defining a hollow cavity therein.

In some embodiments, internal waterway includes a diverter assembly including a diverter rod configured to move relative to the water jacket between an open position and a closed position. The diverter assembly includes one or more seals positioned at an end of the diverter assembly. The diverter assembly includes a bore coaxially aligned with the water jacket. The one or more seals abut the water inlet when the diverter assembly is in the closed position to seal the bore.

In some embodiments, the internal waterway includes a diverter assembly selectively repositionable between an open position and a closed position. The diverter assembly permits water to flow through the internal waterway when the diverter assembly is in the open position. The diverter assembly prevents water from flowing through the internal waterway when the diverter assembly is in the closed position.

Another example embodiment relates to an internal waterway. The internal waterway is configured to deliver water between a water inlet and a water outlet of a bath faucet. The internal waterway includes a water jacket and a hose. The water jacket is coupled to the water inlet and configured to contain water. The water jacket includes a hose connector along an outside surface of the water jacket and protruding outward from the water jacket and positioned substantially offset from a midpoint of the water jacket. The hose connector includes a hole extending therethrough. The water jacket includes a circumferential sidewall defining a hollow cavity therein. The hose includes a first end coupled to the hose connector, a second end coupled to the water outlet, and a central portion connecting the first end to the second end and configured to transfer water therein.

In some embodiments, the internal waterway includes a receptacle coaxially aligned with the water jacket along an axis. The receptacle is at least partially disposed through a top of the water jacket. In some embodiments, the internal waterway includes a diverter assembly including a diverter rod extending through the receptacle and configured to move relative to the water jacket between an open position and a closed position. In still some embodiments, the diverter assembly includes one or more seals positioned between the diverter rod and the water jacket. The one or more seals includes a first set of seals and a second set of seals. The first set of seals are configured to prevent water from leaking out of the water jacket via the aperture. The second set of seals are configured to prevent water from entering the diverter assembly when the diverter rod is in the closed position. In still some embodiments, the hose defines a curvilinear sidewall extending from the first end to the second end.

This summary is illustrative only and should not be regarded as limiting.

BRIEF DESCRIPTION OF THE FIGURES

The disclosure will become more fully understood from the following detailed description, taken in conjunction with the accompanying figures, wherein like reference numerals refer to like elements, in which.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, disclosed herein is a bath faucet system that facilitates utilizing a wider range of materials for the bath faucet body without disrupting operation of the diverter rod. According to an exemplary embodiment, the disclosed bath faucet system includes a waterway that is fluidly coupled to a water supply and is configured to receive water from the water supply. The waterway is also fluidly coupled to a conduit and is configured to provide the water to the conduit. The conduit is disposed within a faucet body and is configured to be routed away from a diverter rod disposed within the faucet body. The conduit is fluidly coupled to a bath faucet outlet through a spout of the faucet body and is configured to provide water to the bath faucet outlet. The bath faucet outlet is configured to dispense the water. In this manner, water does not make contact with the faucet body itself while also avoiding contact with the diverter rod.

Figure 1:
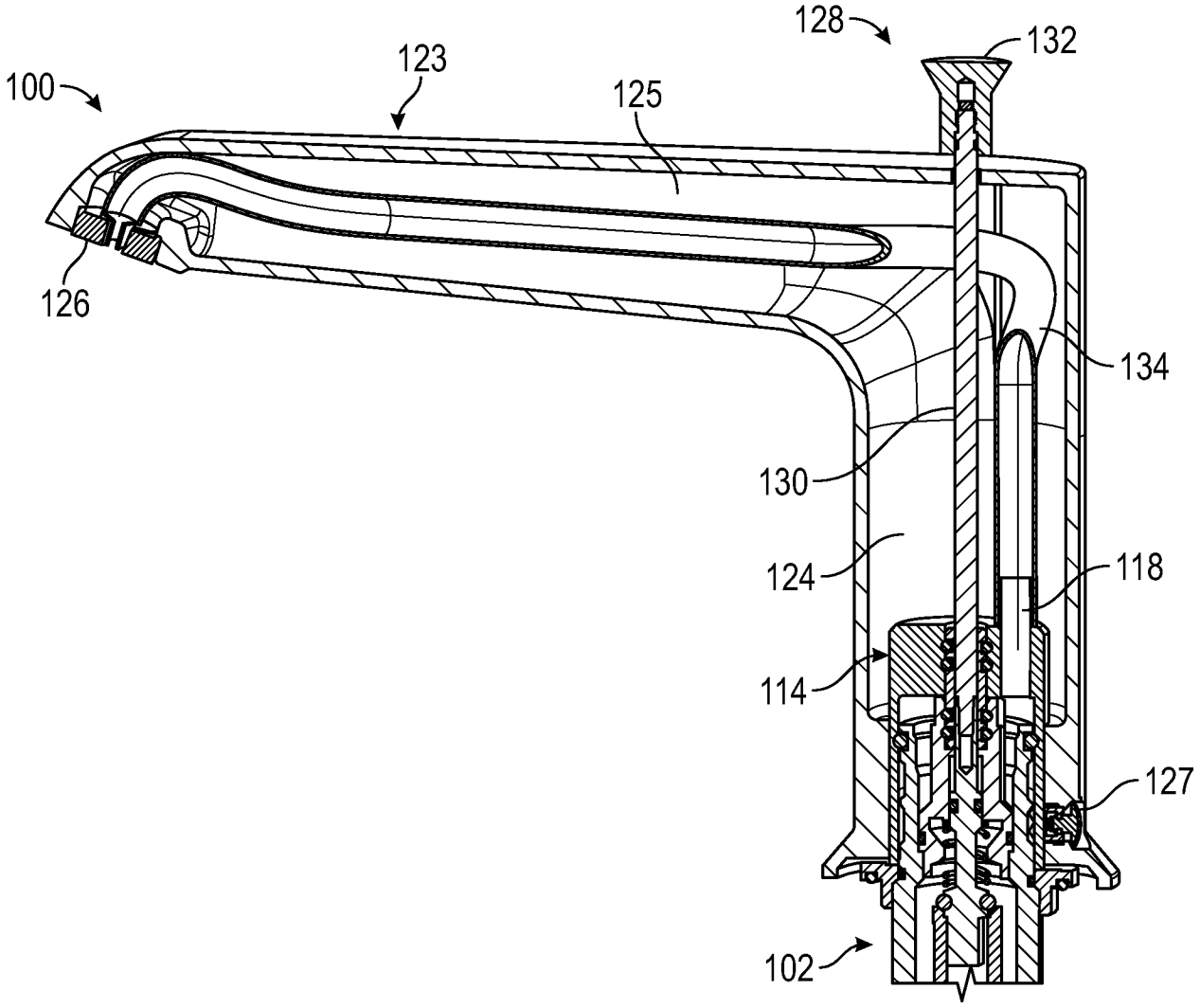
FIG. 1 is a perspective view of a cross-section of a bath faucet system according to an exemplary embodiment.
Figure 2:
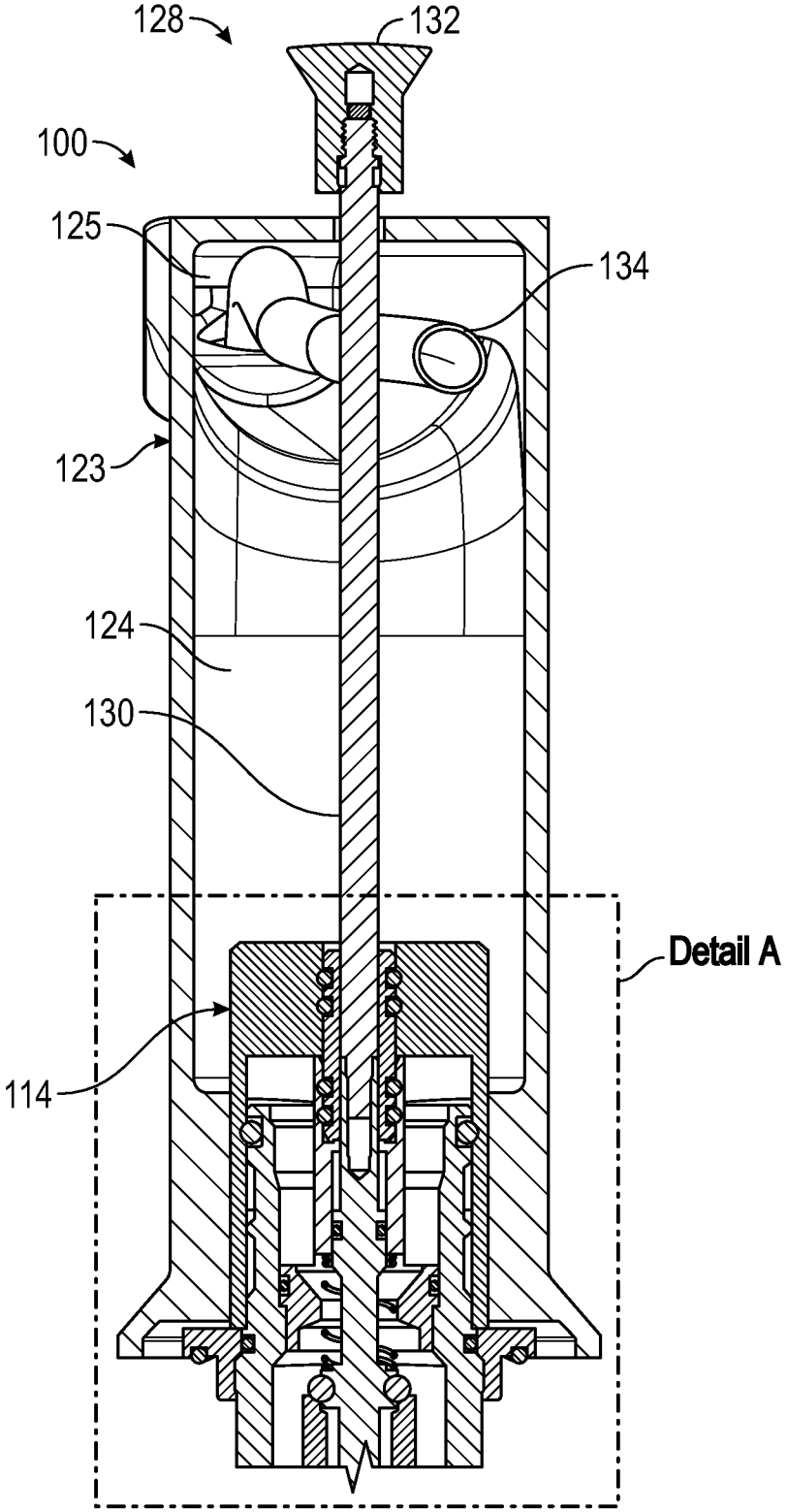
FIG. 2 is a rear view of the bath faucet system shown in FIG. 1 with select components omitted, according to an exemplary embodiment.

Referring to FIGS. 1 and 2, a bath faucet system 100 is shown according to an exemplary embodiment. The bath faucet system 100 may dispense water for a bath tub. However, the bath faucet system 100 may also be utilized for a kitchen sink, a bathroom sink, a spa, etc. The bath faucet system 100 may include a water supply 102, such as a household water supply. The water supply 102 may provide water to be dispensed by the bath faucet system 100. The water supply 102 may deliver at least one of a hot water, a cold water, and a mixture of hot and cold water.

The bath faucet system 100 may include a faucet body 123 (e.g., body, cavity, etc.). The faucet body 123 may include a base 124 and a spout 125 extending from the base 124 to an outlet 126. The base 124 of the faucet body 123 may be disposed onto the water jacket 114. In this manner, the faucet body 123 can be positioned relative to the water jacket 114 and the water supply 102. The faucet body 123 may be configured to conceal the interior components of the bath faucet system 100 to provide a user a more aesthetically pleasing appearance. The water jacket 114 may be configured so that the faucet body 123 minimizes contact with water. In this manner, the faucet body 123 may be composed of a wider range of materials since the materials have little to no exposure to water. These materials may include, but are not limited to, zinc, copper, brass, and aluminum. Accordingly, the wider range of materials provides different aesthetics for the bath faucet system 100 that may not have been readily available before. As can be appreciated, a water pH within a range of 6.5 to 8.5 may cause elements of the faucet body 123 to break down which substantially decreases the life span of the bath faucet system 100, and could potentially be harmful to a user. By way of example, the faucet body 123 may be formed of a material having a low level of resistance to fluids within a pH range of 6.5 to 8.5.

The water jacket 114 may include a waterway outlet 118 (e.g., water exit, waterway connector, etc.). The waterway outlet 118 may be fluidly coupled to the cavity 116 and may be configured to receive water from the cavity 116. The waterway outlet 118 may be configured to provide water to be dispensed by the bath faucet system 100. The waterway outlet 118 may extend away from the water jacket 114. The waterway outlet 118 may be disposed at an offset position relative to the location of a diverter rod 130 disposed in the water jacket 114. In this manner, the waterway outlet 118 can provide a flow path for water to exit the water jacket 114 that does not disrupt the operation of the diverter rod. In an exemplary embodiment, the diverter rod is disposed at the center of the water jacket 114. In these embodiments, the waterway outlet 118 is offset the center of the water jacket 114. In another exemplary embodiment, the diverter rod is disposed offset the center of the water jacket 114. In these embodiments, the waterway outlet 118 is disposed radially away from the disposition of the diverter rod.

The bath faucet system 100 may further include a fastener 127 (e.g., bolt, rivet, etc.). The fastener 127 may be disposed within a cavity at the base of the faucet body 123. The fastener 127 may also extend through a hole disposed within the base of the water jacket 114. When fastened, the fastener 127 may be configured to couple the faucet body 123 onto the water supply 102. Further, after being fastened, the water jacket 114 may be interposed between the faucet body 123 and the water supply 102 in a confronting relationship. In this manner, the fastener 127 may secure the water supply 102, the water jacket 114, and the faucet body 123 together and minimizes play (e.g., movement between components) due to an external force (e.g., force generated by water flow or force generated by the user).

The bath faucet system 100 may also include a diverter assembly 128. When activated by the user, the diverter assembly 128 may be configured to divert water from the bath faucet system 100 to an external faucet or other water delivery device (e.g., showerhead, etc.). The diverter assembly 128 may be selectively repositionable between a lowered position where water may flow into the bath faucet system 100 and a raised position where water may be prevented from flowing into the bath faucet system 100. The diverter assembly 128 may divert water from the bath faucet system 100 by closing an inlet to the bath faucet system 100 and opening an inlet to the external faucet. In this manner, water may flow to the external faucet. In an exemplary embodiment, the user pulls the diverter assembly 128 up (e.g., away from the faucet body 123) to activate the diverter assembly 128 and pushes the diverter assembly 128 down (e.g., towards the faucet body 123) to deactivate the diverter assembly 128. In another exemplary embodiment, the user pushes the diverter assembly 128 up (e.g., towards the faucet body 123) to activate the diverter assembly 128 and pulls the diverter assembly 128 down (e.g., away from the faucet body 123) to deactivate the diverter assembly 128. The diverter assembly 128 may include a variety of sub-components that are described in greater detail with reference to FIG. 3.

The bath faucet system 100 may also include a conduit 134 (e.g., tube, pipe, hose, etc.). The conduit 134 may be fluidly coupled to the waterway outlet 118 at a first end and is configured to receive water from the waterway outlet 118. The conduit 134 may be disposed within the faucet body 123. Due to the waterway outlet 118 being disposed offset to the diverter rod 130, the first end of the conduit 134 may also disposed offset from the diverter rod 130. In this manner, the conduit 134 can receive water from the waterway outlet 118 without disrupting operation of the diverter assembly 128. Due to the diverter assembly 128 being configured to axially translate, the conduit 134 may be configured to be routed in such a way to minimize or eliminate contact with the diverter assembly 128 along the length of the conduit 134. In an exemplary embodiment, the conduit 134 may be composed of a low-friction material. In this manner, even if the conduit 134 were to make contact with the diverter assembly 128, the conduit 134 does not get caught (e.g., stuck) to the diverter assembly 128. In another exemplary embodiment, the conduit 134 is composed of a rigid material and is firmly coupled to the faucet body 123 and the waterway outlet 118. In this manner, even with a larger kickback force by the water (e.g., force generated by the water flow through the bath faucet system 100), the conduit 134 has minimal movement due to being composed of a rigid material. In another exemplary embodiment, the faucet body 123 has a path integrated (e.g., milled, slotted) into the faucet body 123 in which the conduit 134 is disposed in.

In some embodiments, the conduit 134 is integrated into the faucet body 123. In such an embodiment, the conduit 134 is composed of a material that minimizes or experiences no oxidation (e.g., brass, plastic, stainless steel) and where the faucet body 123 may be composed of a different material. In another exemplary embodiment, the conduit 134 is fastened (e.g., through a hook-and-loop, snap-fit, adhesion) to the interior portion of the faucet body 123 along various points of the conduit 134.

In still some embodiments, the conduit 134 may be selectively coupled to the faucet body 123 by mounting components (e.g., clips, adhesive, etc.). In such an embodiment, the conduit 134 is distances away from the diverter assembly 128 to avoid contact. As can be appreciated, if the conduit 134 comes in contact with the diverter assembly 128, the conduit 134 may see increased wear on an outer surface of the conduit 134.

The bath faucet system 100 may include an additional sealing component disposed on or between the conduit 134 and the waterway outlet 118. In this manner, water exiting the waterway outlet 118 only exits through the conduit 134. The additional sealing component may be used to seal (e.g., block, prevent, etc.) an area between the conduit 134 and the waterway outlet 118 to keep fluid (e.g., water) contained within.

The bath faucet system 100 may include the outlet 126 (e.g., exit, vent). The conduit 134 may be fluidly coupled to the outlet 126 and is configured to provide water to the outlet 126. The outlet 126 may be configured to interface with the water before it is dispensed into the tub. In some embodiments, the outlet 126 may be threadingly coupled to an aerator. The outlet 126 may be positioned substantially opposite the waterway connector 118. In some embodiments, the outlet 126 may be positioned proximate the waterway connector 118.

Figure 3:
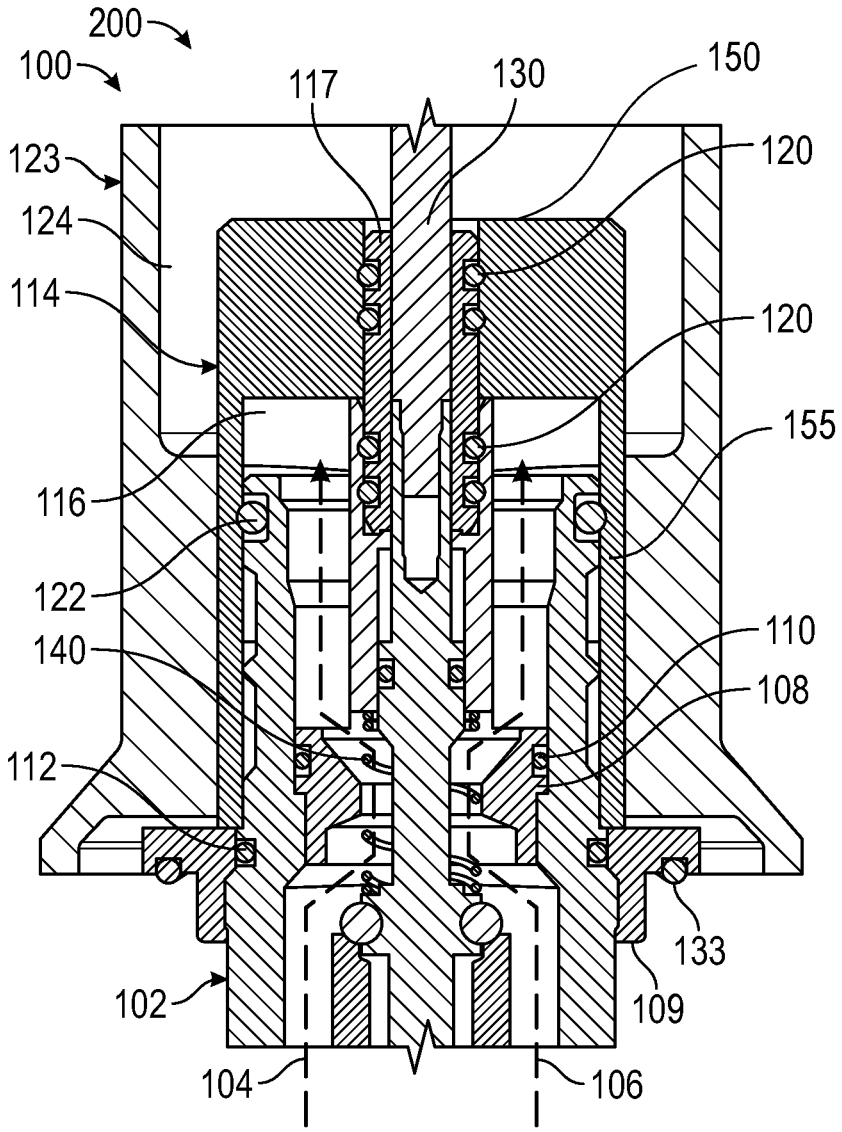
FIG. 3 is a detailed view of the bath faucet system shown in FIG. 2, according to an exemplary embodiment.

Referring now to FIG. 3, the bath faucet system 100 may include a mounting component 108 (e.g., fixture). The mounting component 108 may be coupled to at least one of an interior surface and an exterior surface of the water supply 102. In this manner, the water supply 102 can be mounted and then positioned relative to the mounting component 108. In some embodiments, the mounting component 108 may be coupled to one of an interior surface and an exterior surface. The bath faucet system 100 may include a first sealing component 110 (e.g., O-ring, sealant) disposed between the interior portion of the mounting component 108 and the water supply 102. The first sealing component 110 may mitigate the amount of water entering between the interior portion of the mounting component 108 and the water supply 102. The bath faucet system 100 may include a second sealing component 112 (e.g., O-ring, sealant) disposed between the exterior portion of the mounting component 108 and the water supply 102. The second sealing component 112 may mitigate water ingress from entering within the bath faucet system 100. As can be appreciated, the second sealing component 112 may mitigate water ingress from an area proximate the water supply 102 and the mounting component 108. By way of example, the first sealing component 110 and the second sealing component 112 may be received within a groove of the mounting component 108 and the water supply 102, respectively.

The bath faucet system 100 may include a water jacket 114. The water jacket 114 may be fluidly coupled to the water supply 102 and may be configured to receive water from the water supply 102. The water jacket 114 may be further configured to provide the water to be dispensed by the bath faucet system 100. The water jacket 114 may further include a top, shown as water jacket top 150, and a base, shown as water jacket base 155. The water jacket base 155 may be disposed on the exterior surface of the water supply 102. The water jacket top 150 may be at least partially disposed over the mounting component 108. In this manner, the water jacket 114 can be aligned relative to the water supply 102 and the mounting component 108. In some embodiments, the water jacket 114 is integrated with the water supply 102. The water jacket 114 includes a cavity 116 (e.g., mixing chamber, void). The cavity 116 may receive hot water from the hot water supply 104 and cold water from the cold water supply 106. Accordingly, the hot water and cold water may combine within the cavity 116. The interior portion of the mounting component 108 may extend along a center portion of the cavity 116. In this manner, the water flows around the interior portion of the mounting component 108.

The water jacket 114 may include a bore, passage, aperture or opening, shown as receptacle 117. The receptacle 117 may be disposed on a center axis of the water jacket 114 and extends from the water jacket top 150 to the cavity 116. In this manner, the receptacle 117 provides clearance for a diverter rod of the bath faucet system 100. As discussed in greater detail herein, the diverter rod 130 may be configured to axially translate along a length of the receptacle 117. Accordingly, the receptacle 117 may be sized to accommodate the diverter rod along the entire path of the axial translation. In another exemplary embodiment, the receptacle 117 is disposed offset the center axis of the water jacket 114 when the diverter rod is also disposed offset the center axis of the water jacket 114.

The receptacle 117 may include a plurality of sealing components 120 (e.g., O-rings, sealants, etc.). The plurality of sealing components 120 may be disposed between the receptacle 117 and an inner wall of the water jacket 114. The plurality of sealing components 120 may mitigate water ingress from the flow path traveling through the water jacket 114 from entering into the interior portion of the mounting component 108. The plurality of sealing components 120 may be at least partially received within a plurality of grooves circumferentially disposed along an outer wall of the receptacle 117.

The bath faucet system 100 may include a third sealing component 122 (e.g., O-ring, sealant, etc.). The third sealing component 122 is disposed between the water jacket 114 and the water supply 102. The third sealing component 122 may mitigate water ingress from the cavity 116 from escaping between the water jacket 114 and the water supply 102 and ensures that all water within the water jacket 114 exits via the waterway outlet 118. The third sealing component 122 may be at least partially received within a groove circumferentially disposed along an outer perimeter of the water supply 102.

The bath faucet system 100 may include a fourth sealing component 133 (e.g., O-ring, sealant, etc.). The fourth scaling component 133 may be disposed between faucet body 123 and the water supply 102. The fourth sealing component 133 may mitigate water ingress from outside of the faucet body 123 from entering between the faucet body 123 and the water supply 102. The fourth sealing component 133 may be disposed within a groove positioned on a mounting base 109. In some embodiments, the fourth sealing component 133 may abut a countertop, wall, sink, etc.

In an exemplary embodiment, the water supply 102 may include a hot water supply 104 (e.g., hot water conduit) and a cold water supply 106 (e.g., cold water conduit). The hot water supply 104 may be configured to deliver a flow of hot water to the bath faucet system 100. The cold water supply 106 may be configured to deliver a flow of cold water to the bath faucet system 100. In another exemplary embodiment, the water supply 102 may include a single water source configured to deliver a mixture of at least one of hot and cold water. In these embodiments, the water supply 102 mixes hot and cold water before entering into the bath faucet system 100 or the bath faucet system 100 is configured to dispense either hot or cold water.

Referring now to FIGS. 1-3, the diverter assembly 128 may include a diverter rod 130 (e.g., pole, dowel). A first end of the diverter rod 130 may be disposed within the interior portion of the mounting component 108. In this manner, when the diverter assembly 128 is applied, the diverter rod 130 may be axially translated away the water supply 102. The diverter rod 130 may be further disposed within the receptacle 117 of the water jacket 114. In this manner, the receptacle 117 may facilitate the diverter rod 130 to axially translate along the full length of travel when the diverter assembly 128 is applied. Further, the receptacle 117 may act as a datum (e.g., a fixed starting point) as the diverter rod 130 is centered relative to the water jacket 114. In this manner, the waterway outlet 118 is disposed a specified distance away from the diverter rod 130 which prevents disrupting operation of the diverter assembly 128. This axial translation may result in the inlet to the bath faucet system 100 to be blocked while opening the inlet to the external faucet. Accordingly, when the diverter assembly 128 is no longer applied, the diverter rod 130 may be axially translated towards the water supply 102. This axial translation may result in the inlet to the bath faucet system 100 to open while blocking the inlet to the external faucet.

The diverter assembly 128 may include a diverter handle 132 (e.g., knob). The diverter handle 132 may be at least partially disposed on an outer portion of the faucet body 123. In some embodiments, the diverter handle 132 may be disposed within an inner portion of the faucet body 123 where a user provides a push force onto the diverter handle 132 to actuate the diverter assembly 128. The diverter handle 132 may be coupled to a second end of the diverter rod 130, opposite the water jacket 114. The user may utilize the diverter handle 132 to push or pull the diverter rod 130 to deactivate or activate the diverter assembly 128.

Figure 4:
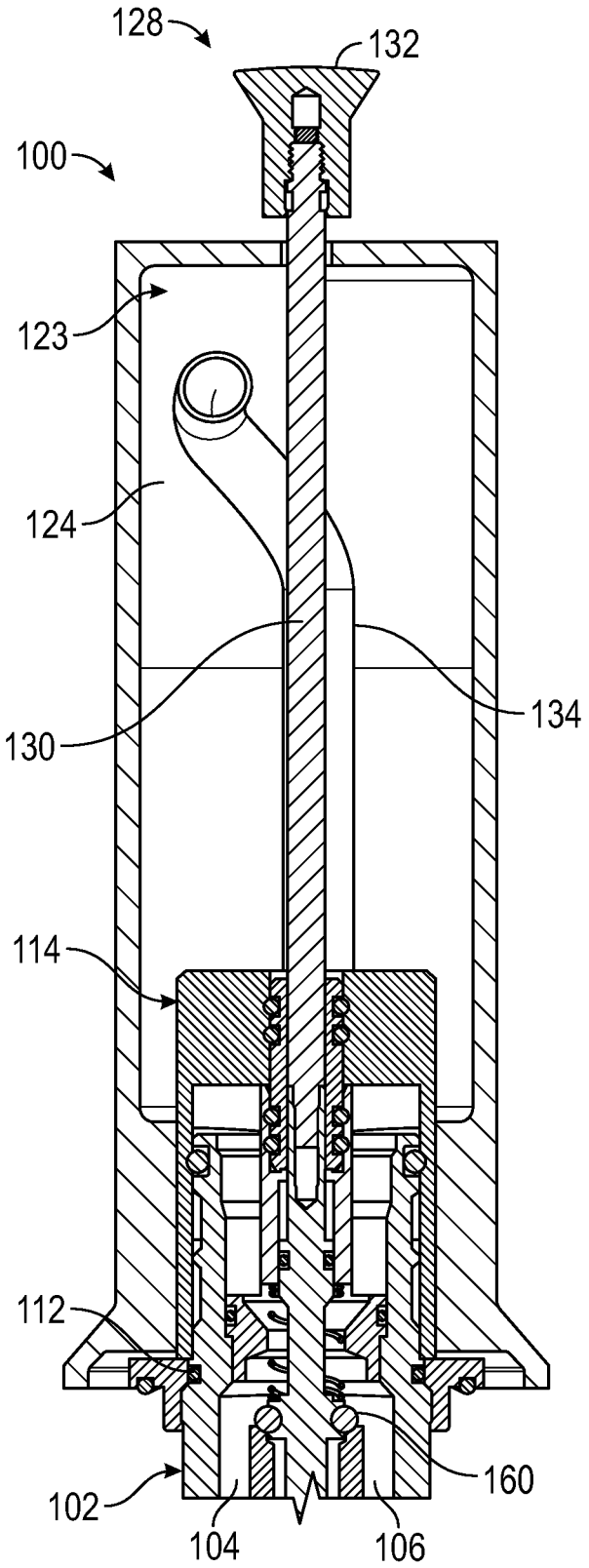
FIG. 4 is a front view of the bath faucet system shown in FIG. 1 with select components omitted, according to an exemplary embodiment.

Referring now to FIGS. 3 and 4, the diverter assembly 128 may include a diverter scaling component 160 (e.g., O-ring, sealant, etc.). The diverter sealing component 160 may be coupled to the diverter rod 130, opposite the diverter handle 132. By way of example, the diverter sealing component 160 may be configured to abut the mounting component 108 when the diverter assembly 128 is in the raised position. That is, when in the raised position, the diverter sealing component 160 may abut an inner surface of the mounting component 108 so that at least one of hot water and cold water may not pass through an internal passage of the mounting component.

The water jacket 114, diverter assembly 128, and the conduit 134 may at least cooperatively define an internal waterway 200. The internal waterway 200 may be configured to deliver water from a water inlet (e.g., hot water supply 104, cold water supply 106, hose connector 118, etc.) to a water outlet (e.g., water outlet 126 in FIG. 1). The internal waterway 20 may further include a spring 140 disposed between the receptacle 117 and the diverter scaling component 160. The spring 140 may further abut at least one of the receptacle 117 and the diverter rod 130. The spring 140 may be configured to bias the diverter assembly 128 into the lowered position by providing a biasing force onto the diverter rod 132 at an end proximate the diverter sealing component 160. In some embodiments, the spring 140 may be configured to bias the diverter assembly 128 into the raised position. By way of example, the operator may provide a pull force onto the diverter handle 132 to raise the diverter assembly 128 into the raised position, where the pull force must be greater than the biasing force. When in the raised position, water from the hot water supply 104 and the cold water supply 106 may provide a pressure onto a rearward side of the diverter sealing component 160 such to maintain the diverter assembly 128 into the raised position when the operator releases the diverter handle 132. In some embodiments, the diverter assembly 128 may automatically retract into the lowered position when the operator releases the diverter handle 132.

Figure 5:
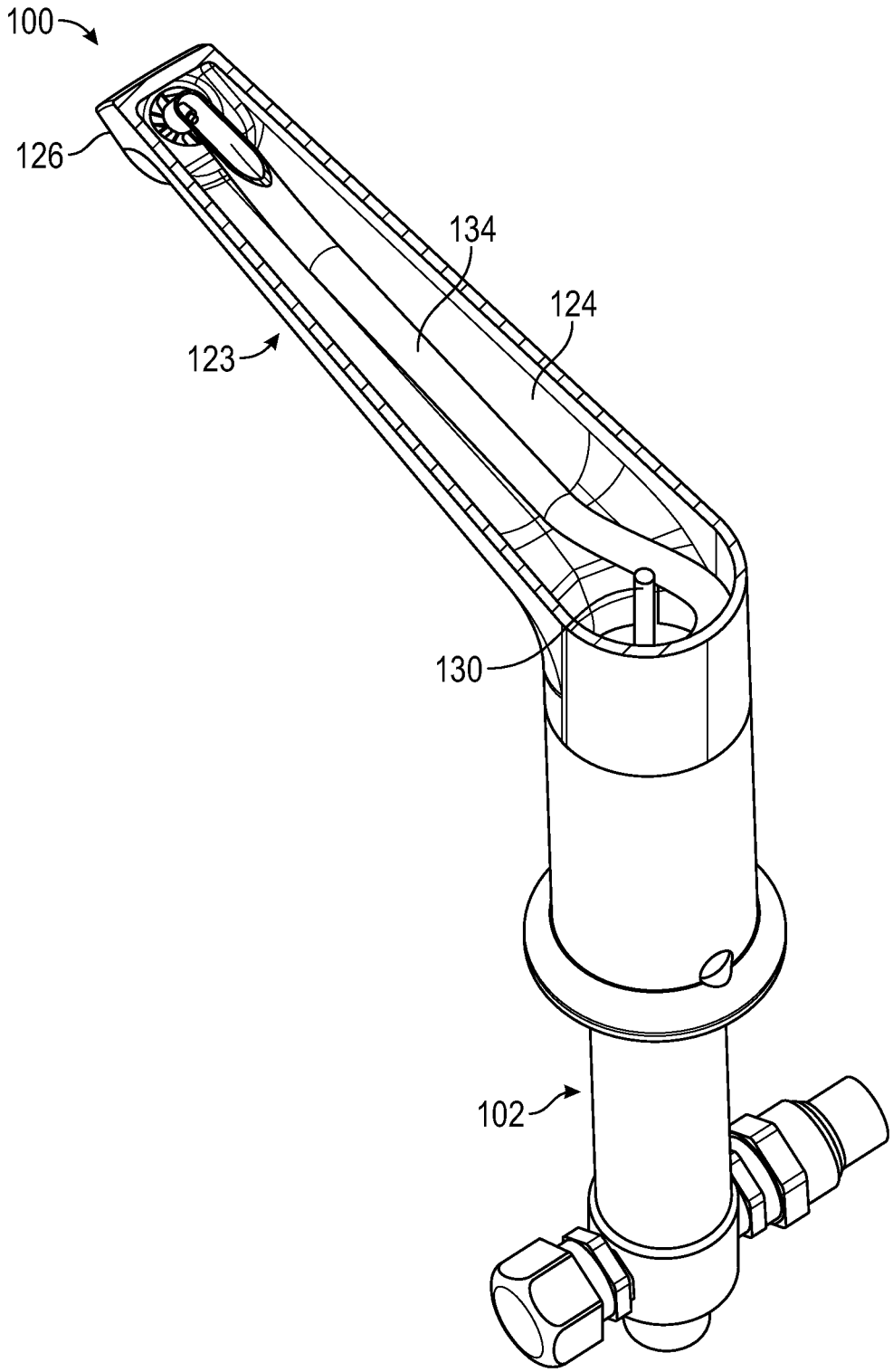
FIG. 5 is another perspective view of the bath faucet system shown in FIG. 1 with select components omitted, according to an exemplary embodiment.
Figure 6:
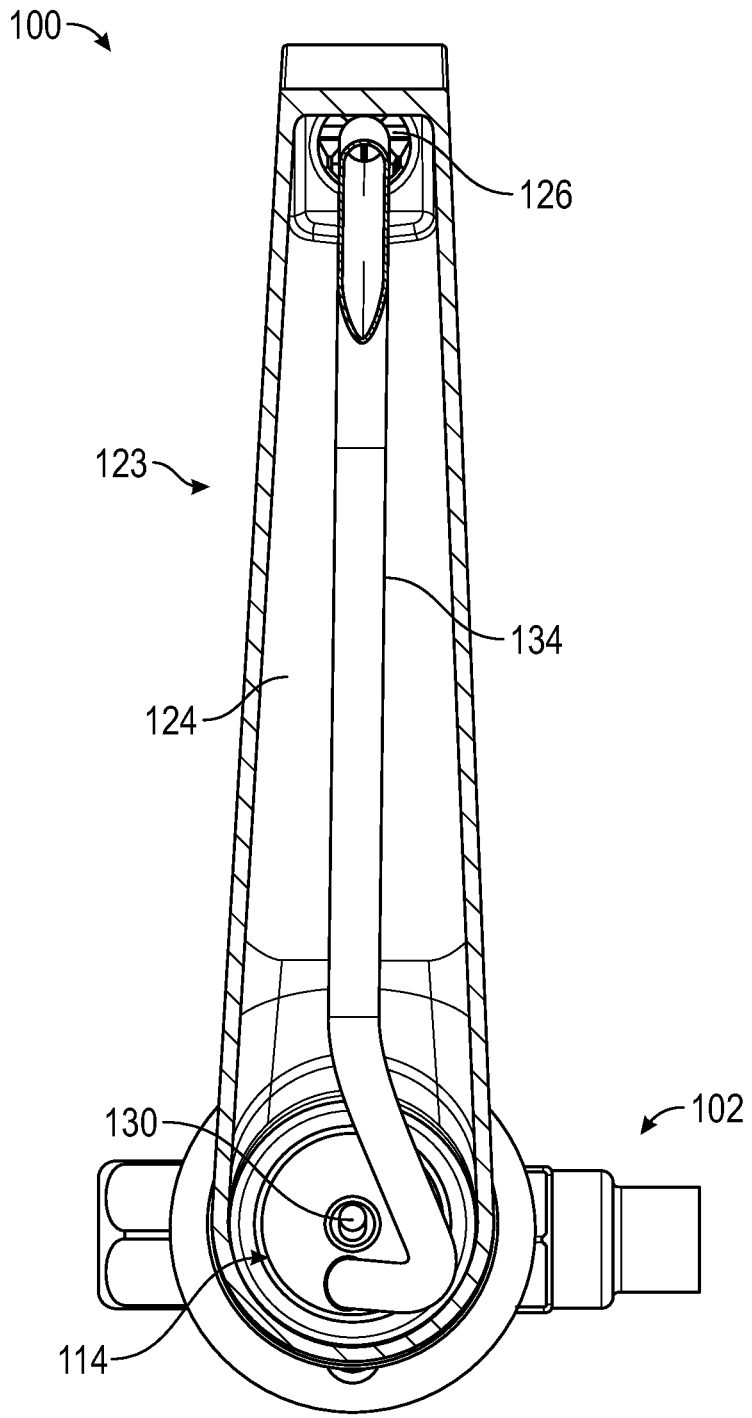
FIG. 6 is a top view of the bath faucet system shown in FIG. 1 with select components omitted, according to an exemplary embodiment.

Referring now to FIGS. 5 and 6, the conduit 134 may be disposed between the water inlet and outlet 126. The conduit 134 may define a curvilinear sidewall extending between the water inlet and outlet 126 with a hollow cavity therein. In some embodiments, the conduit 134 may define any geometrical configuration with a hollow cavity disposed therein for transferring water from the water inlet to the outlet 126. As shown in FIG. 6, the conduit 134 may extend away from, and out of interaction with, the diverter assembly 128. As can be appreciated, maintaining a minimal distance between the diverter assembly 128 and the conduit 134 may increase the life cycle for at least the conduit 134 and the diverter assembly 128 (e.g., 5 mm, 10 mm, 15 mm, 20 mm, etc.).

Figure 7:
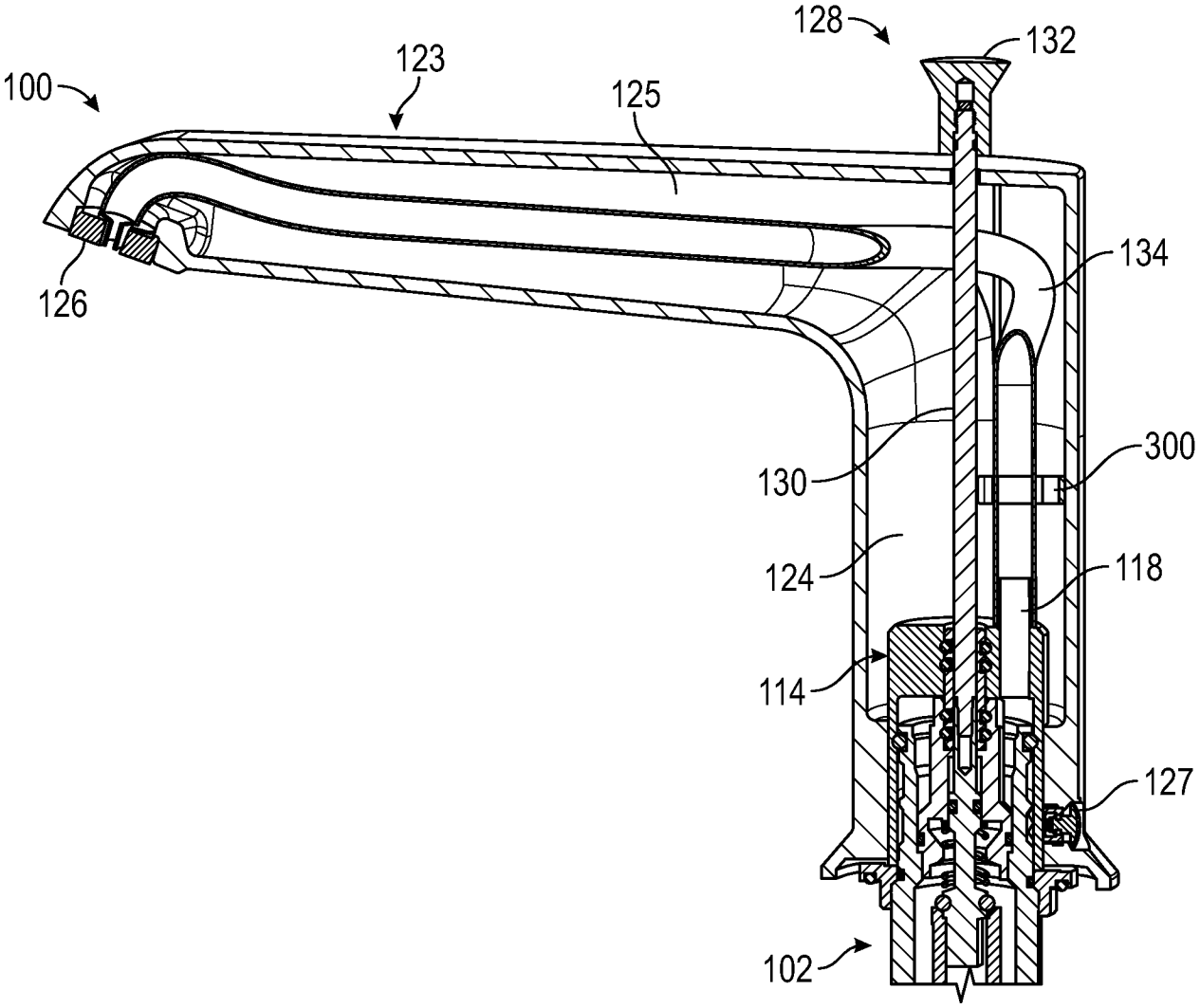
FIG. 7 is a perspective view of a cross-section of a bath faucet system according to an exemplary embodiment.

Referring now to FIG. 7, the bath faucet system 100 is shown, according to an exemplary embodiment. The bath faucet system 100 may include mounting clips 300 positioned on an inner wall of the faucet body 123. In such an embodiment, the mounting clips 300 may be configured to receive the conduit 134 to hold the conduit in place. The mounting clips 300 may further be configured to receive the conduit such to maintain a minimum distance between the conduit 134 and the diverter assembly 128.

Figure 8:
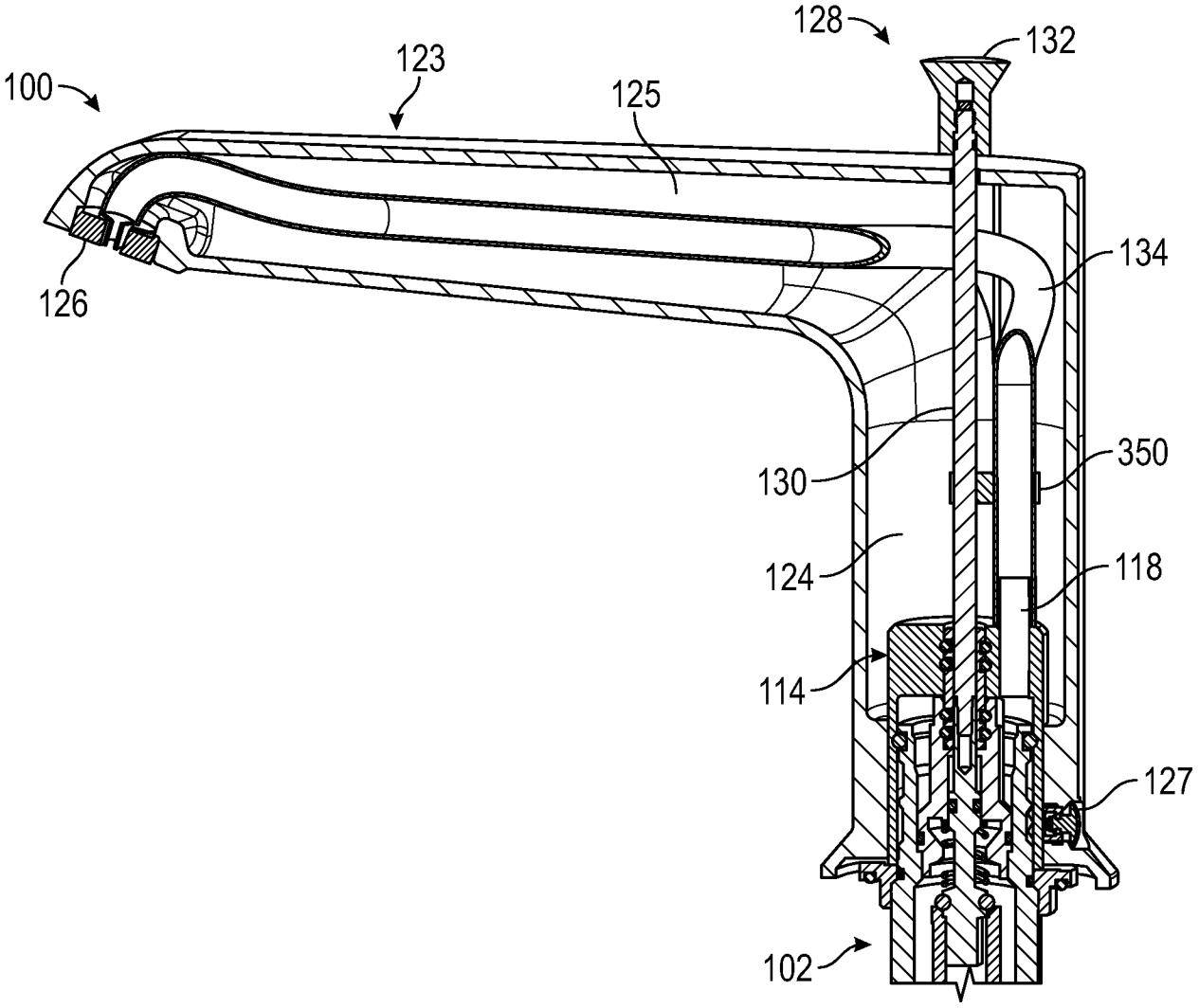
FIG. 8 is a perspective view of a cross-section of a bath faucet system according to an exemplary embodiment.

Referring now to FIG. 8, the bath faucet system 100 is shown, according to an exemplary embodiment. The bath faucet system 100 may include a spacer 350 positioned between at least the diverter assembly 128 and the conduit 134. The spacer 350 may be advantageously positioned to minimize contact between the conduit 134 and the diverter assembly 128. As can be appreciated, increased contact between the conduit 134 and the diverter assembly 128 may inadvertently decrease a lifespan of at least the conduit 134 and the diverter assembly 128.

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

It is important to note that any element disclosed in one embodiment may be incorporated or utilized with any other embodiment disclosed herein. For example, the fastener 127 of the exemplary embodiment described in at least FIG. 1, it may also be incorporated in the exemplary embodiment illustrated in FIG. 3. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. A bath faucet system, comprising:

a housing comprising a water inlet, a water outlet, and a cavity extending between the water inlet and the water outlet;

an internal waterway disposed within the cavity between the water inlet and the water outlet, the internal waterway comprising:

a water jacket coupled to the water inlet and comprising a hose connector and a separate aperture through the water jacket;

a hose coupled to the hose connector and the water outlet and configured to prevent water from contacting the housing as water flows through the internal waterway; and a diverter rod extending through the separate aperture of the water jacket and through a flow path of the water within the water jacket, the diverter rod configured to move relative to the water jacket between an open position and a closed position.

2. The bath faucet system of claim 1, wherein the hose connector protrudes outward from an outside surface of the water jacket.

3. The bath faucet system of claim 1, wherein the hose connector is offset from the separate aperture such that the hose does not abut the diverter rod within the cavity.

4. The bath faucet system of claim 1, further comprising one or more seals positioned between the diverter rod and the water jacket.

5. The bath faucet system of claim 4, wherein the one or more seals comprise a first set of seals and a second set of seals;

wherein the first set of seals are positioned between the diverter rod and the water jacket and configured to prevent water from leaking out of the water jacket via the separate aperture; and wherein the second set of seals are positioned between the diverter rod and an inlet to a diverter assembly and configured to prevent water from entering the diverter assembly when the diverter rod is in the closed position.

6. The bath faucet system of claim 1, wherein the housing comprises mounting clips fixedly coupled to an internal surface of the housing and configured to receive the hose.

7. The bath faucet system of claim 1, wherein the water jacket comprises a circumferential sidewall defining a hollow cavity therein.

8. The bath faucet system of claim 1, wherein the hose further comprises a first end coupled to the hose connector, a second end coupled to the water outlet, and a central portion connecting the first end to the second end.

9. The bath faucet system of claim 8, wherein the central portion of the hose defines a curvilinear sidewall extending between the water jacket and the water outlet.

10. The bath faucet system of claim 1, wherein the diverter rod permits water to flow through the bath faucet system when the diverter rod is in the open position and prevents water from flowing through the bath faucet system when the diverter rod is in the closed position.

11. An internal waterway configured to deliver water between a water inlet and a water outlet of a bath faucet, the internal waterway comprising:

a water jacket coupled to the water inlet and comprising a hose connector and a separate aperture through the water jacket;

a hose coupled to the hose connector and the water outlet and configured to transfer water therein; and a diverter rod extending through the separate aperture of the water jacket and through a flow path of the water within the water jacket, the diverter rod configured to move relative to the water jacket between an open position and a closed position.

12. The internal waterway of claim 11, wherein the hose connector protrudes outward from an outside surface of the water jacket.

13. The internal waterway of claim 11, further comprising one or more seals coupled to the diverter rod and configured to move along with the diverter rod between the open position and the closed position.

14. The internal waterway of claim 13, wherein the one or more seals abut the water inlet and prevent the water from flowing into the water jacket via the water inlet when the diverter rod is in the closed position.

15. The internal waterway of claim 11, wherein the diverter rod permits the water to flow through the internal waterway when the diverter rod is in the open position and prevents the water from flowing through the internal waterway when the diverter rod is in the closed position.

16. An internal waterway configured to deliver water between a water inlet and a water outlet of a bath faucet, the internal waterway comprising:

a water jacket coupled to the water inlet and comprising a first aperture permitting the water to exit the water jacket and a second aperture permitting a diverter rod of the bath faucet to extend through the water jacket and through a flow path of the water within the water jacket; and a hose coupled to the first aperture of the water jacket and to the water outlet;

wherein the water jacket and the hose are contained at least partially within a housing of the bath faucet and configured to prevent the water from contacting the housing when the water flows through the internal waterway.

17. The internal waterway of claim 16, wherein the second aperture permits the diverter rod to move relative to the water jacket between an open position and a closed position.

18. The internal waterway of claim 16, wherein the water jacket further comprises a hose connector protruding outward from an outside surface of the water jacket and aligned with the first aperture.

19. The internal waterway of claim 16, comprising one or more seals positioned between the diverter rod and the water jacket and configured to prevent the water from leaking out of the water jacket via the second aperture.

20. The internal waterway of claim 16, wherein the water jacket comprises a hollow cavity configured to contain the water therein, both the first aperture and the second aperture connect to the hollow cavity, the first aperture permits the water to flow out of the water jacket and into the hose, and the water is prevented from leaking out of the water jacket via the second aperture.

* * * * *